US009750378B2

(12) United States Patent
Rathbone

(10) Patent No.: US 9,750,378 B2
(45) Date of Patent: Sep. 5, 2017

(54) POTTY

(75) Inventor: Jon Rathbone, Dursley (GB)

(73) Assignee: Pourty International Limited, Gloucestershire (GB)

( * ) Notice: Subject to any disclaimer, the term of this patent is extended or adjusted under 35 U.S.C. 154(b) by 1639 days.

(21) Appl. No.: 13/141,409

(22) PCT Filed: Dec. 9, 2009

(86) PCT No.: PCT/GB2009/051677
§ 371 (c)(1),
(2), (4) Date: Sep. 15, 2011

(87) PCT Pub. No.: WO2010/073027
PCT Pub. Date: Jul. 1, 2010

(65) Prior Publication Data

US 2011/0314598 A1 Dec. 29, 2011

(30) Foreign Application Priority Data

Dec. 22, 2008 (GB) ..... 0823357.9
Apr. 22, 2009 (GB) ..... 0906896.6

(51) Int. Cl.
*A47K 11/04* (2006.01)
*A47K 11/06* (2006.01)

(52) U.S. Cl.
CPC ..... *A47K 11/06* (2013.01)

(58) Field of Classification Search
USPC .... 4/483, 476, 455, 450, 480, 449; D23/296
See application file for complete search history.

(56) References Cited

U.S. PATENT DOCUMENTS

| | | | | | |
|---|---|---|---|---|---|
| 1,181,162 | A | * | 5/1916 | La Fayette | 4/483 |
| 2,776,438 | A | * | 1/1957 | Zeraffa | 4/483 |
| 3,329,973 | A | | 7/1967 | Bobbe | |
| 3,625,654 | A | | 12/1971 | Van Duyne | |
| 4,193,142 | A | * | 3/1980 | Henningfield | 4/483 |
| 5,787,518 | A | * | 8/1998 | Mendelovich et al. | 4/449 |
| 5,953,763 | A | | 9/1999 | Gouget | |
| 6,112,339 | A | | 9/2000 | Nichols et al. | |
| 2005/0132484 | A1 | | 6/2005 | Chao | |

FOREIGN PATENT DOCUMENTS

| | | | |
|---|---|---|---|
| CN | 2193708 | | 4/1995 |
| DE | 19837480 | A1 * | 4/2000 |
| FR | 1 514 151 | | 2/1968 |

(Continued)

OTHER PUBLICATIONS

Translation of DE 198 37 480.*

(Continued)

*Primary Examiner* — Lauren Crane
(74) *Attorney, Agent, or Firm* — Hunton & Williams LLP

(57) ABSTRACT

A potty (10) includes a sidewall (12), basin (14) and a top surface (15) including a seating surface (18). The potty (10) is arranged such that it can be stacked with a similar potty such that a part of one is received within the other. This results in the combined height of the stacked potties being less than twice the height of an individual potty. The potty (10) has a duct (20) that enables liquid to be poured from the basin (14) out of the potty substantially without coming into contact with the seating surface (18).

10 Claims, 7 Drawing Sheets

(56) References Cited

FOREIGN PATENT DOCUMENTS

| | | |
|---|---|---|
| FR | 1514151 | 2/1968 |
| GB | 1 304 372 | 1/1973 |
| JP | 3081729 | 8/2001 |
| JP | 2004-187695 | 7/2004 |
| JP | 2007-275522 | 10/2007 |
| WO | WO 95/22275 | 8/1995 |
| WO | WO 95/32659 | 12/1995 |
| WO | WO 00/25648 | 5/2000 |
| WO | WO 2007/046961 | 4/2007 |
| WO | WO 2010/058173 | 5/2010 |

OTHER PUBLICATIONS

International Search Report Application No. PCT/GB2009/051677 dated Mar. 1, 2010.
UK Patent Office search report from application GB0823357.9 dated Feb. 18, 2009.
Notice on the Third Office Action, The State Intellectual Property Office of the People's Republic of China, Chinese Patent Application No. 200980152992.7, Feb. 8, 2014, pp. 1-7.
Notice on the Second Office Action, The State Intellectual Property Office of the People's Republic of China, Chinese Patent Application No. 20098152992.7, Jul. 19, 2013, pp. 1-3.
Notice on the First Office Action, The State Intellectual Property Office of the People's Republic of China, Chinese Patent Application No. 200980152992.7, Nov. 22, 2012.
Notice of Reasons for Rejection, Japanese Patent Office, Japanese Patent Application No. P2011-541592, Jun. 20, 2013, pp. 1-2.
Inquiry Under the Substantive Examination, The Federal Institute of Industrial Property, Russian Patent Application No. 2011129072/12 (042964), Dec. 6, 2012, pp. 1-5.
PCT Notification of Transmittal of the International Search Report and the Written Opinion of the International Searching Authority, WIPO, International Application No. PCT/GB2009/051677, Mar. 8, 2010, pp. 1-15.

* cited by examiner

POTTY

FIELD OF THE INVENTION

The present invention relates to a potty.

BACKGROUND OF THE INVENTION

A potty is a well known article, generally consisting of a sidewall, a seating surface and a basin. A child may sit on the seating surface and pass bodily waste into the basin. The waste may then be transferred from the basin to, for example, a toilet by tipping the potty. However, it can sometimes be difficult to empty the waste from the potty in a controlled manner. Furthermore, in some cases, waste may pass over the seating surface when the potty is emptied, which is undesirable from a hygiene perspective.

Potties are mass produced, reasonably low cost, items and as such it is beneficial if a number of potties can be stacked together for storage, transportation and display.

SUMMARY OF THE INVENTION

In accordance with an aspect of the present invention, there is provided a potty including a basin, a seating surface and a duct arranged to enable liquid to be poured out of the basin substantially without the liquid contacting the seating surface, wherein the potty is configured to be stackable with a similar potty such that at least a part of the potty may be received by the similar potty. Thus, the potty according to this aspect of the present invention provides a passageway for liquid to pass from the basin to a target site, such as a toilet, without the waste passing over the surface of the potty arranged to be sat on. Consequently, the surface or surfaces that a user's skin will normally contact will generally not be contaminated by waste being emptied from the basin. Furthermore, the duct provides for controlled pouring of liquid from the basin. The configuration of the potty, including the duct, is such that it does not prevent the potty being stackable with a similar potty, and in some embodiments a substantially identical potty, such at least some of one potty is received by the other. This means that a plurality of potties according to this aspect of the invention can be stacked in a space-saving arrangement, which is desirable from a transportation, storage and display perspective. Depending upon the configuration of the surfaces in question, the combined height of the two potties may be less than twice the height of a single potty, less than one and a half times the height of a single potty and in some cases substantially 1.2 or 1.1 times the height of a single potty.

In some embodiments, one end of the duct is provided at or adjacent to a first opening formed through a surface of the potty, such that liquid can be poured along the duct to and out of the first opening. This provides a convenient means of emptying waste from the potty.

In some embodiments the potty includes a back rest and the opening is formed through a part of the backrest. The backrest may define a support surface arranged to support the lower back of a user and thus prevent the user from sitting any further back on the potty than the backrest. The duct is spaced from the support surface such that the support surface prevents a user's skin, in normal use of the potty, from coming into contact with the duct.

In some embodiments a second opening is formed through the primary sidewall at a location corresponding to the first opening, the second opening being larger than the first opening. Thus, liquid or solids can be poured through the first opening and pass through the second opening. The second opening is arranged such that liquid or solids can be poured through the first and second openings substantially without contacting the inner face of the primary sidewall, which may require cleaning.

In some embodiments, the potty is configured such that the part of the potty arranged to be received by the other potty includes at least a part of the duct. Thus, a part of the potty including the duct is arranged to be received by another, similar, potty. In some embodiments this may provide for a large part of the potty to be received by another potty. In some embodiments an end of the duct is arranged to be received by another potty. In other embodiments more than one third and in some embodiments more than half or two thirds of the duct is arranged to be received by another potty. In some embodiments each end of the duct is arranged to be received by another potty.

In some embodiments, the potty includes a primary sidewall, the basin includes a basin sidewall and the seating surface is provided between the sidewalls. When this is the case, a cavity may be defined between the primary sidewall and basin sidewall at a space below the seating surface, the cavity being arranged to receive at least a part of a second similar potty. Thus the potty according to this embodiment of the invention has an open bottom defining a cavity within which a part of a similar and in some embodiments, substantially identical, potty can be received during stacking.

In some embodiments, the duct is arranged such that it crosses the seating surface. Since much of the top surface of the potty is generally arranged to be sat on, if the duct extends from the basin to the side of the potty it will generally cross the seating surface whereas if the duct extends from the basin to the back of the potty it may in some cases cross the seating surface. When this is the case, the seating surface may include a channel extending across the seating surface, the channel having a channel base along which the duct passes. This results in the duct intersecting the seating surface. The duct and channel are the same width in some embodiments and thus the channel can be thought of as an increase in the depth of the duct at the part of the duct corresponding to the channel. The liquid transfer surface of the duct should be provided below the general plane of the adjacent part of the seating surface to prevent poured liquid from contacting the seating surface. The duct should be configured such that a user sitting on the seating surface will not contact a surface of the duct. Alternatively, or in addition, the potty may include a back rest including a support face and the duct extends across the support face of the backrest. Thus, the duct may run along the backrest such that waste can be poured from the potty by tipping it backwards. Either the depth of the duct itself, or the depth of the channel containing the duct, prevents a user's back from contacting a surface of the duct. As an alternative to the latter, the potty may further include a drain aperture formed through a surface thereof, the duct extending to the drain aperture such that liquid may flow from an area of the basin to the drain aperture via the duct. Thus, the duct may lead to a drain aperture formed through a surface of the potty such that waste can pass through it and into the cavity between the primary sidewall and the basin sidewall. The potty may include a back rest having a support surface and the drain aperture is formed through the support surface of the back rest. Liquid can thus be poured from the basin though the drain aperture and into the cavity between the primary sidewall and the basin sidewall, which is open bottomed.

In some embodiments, the duct extends from a part of the basin without crossing the seating surface. In such a case, the seating surface can be a continuous surface, for example not having a lateral recess which a user may find uncomfortable. This enables the duct to be, for example, an open conduit that runs from the basin substantially to the top of the primary sidewall without crossing the seating surface which may require that, either the duct is sufficiently recessed to be out of contact with a user when sat on the potty or the duct is covered and/or passes under the seating surface. In this case also, the potty may further include a drain aperture formed through a surface thereof, the duct extending to the drain aperture such that liquid may flow from an area of the basin to the drain aperture via the duct. When this is so, the drain aperture may be formed through the basin sidewall. This has the advantage that the channel does not cross the seating surface which may cause discomfort to a user. In the embodiments where a drainage aperture is provided, the primary sidewall may be provided with an opening at a location corresponding to the drainage aperture, the opening being larger in size than the drainage aperture. By providing an opening, it reduces the likelihood that waste poured through the drain aperture will contact the interior face of the primary sidewall i.e. inside the cavity. The potty may include a projection arranged to provide a splash guard function, the duct extending along the projection, substantially to the tip thereof. A splash guard is an advantageous feature of a potty and is a surface that is not arranged to be sat on. The duct may therefore extend along the splash guard, meaning that it does not cross the seating surface. When this is the case, the duct may be configured to limit splash from incident liquid. For example, the duct may have a semicircular cross section through a plane perpendicular to its longitudinal axis, or other suitable configuration.

In some embodiments, at least some of the basin may be arranged to be received, when stacked, within the basin of the substantially identical potty. This provides for efficient stacking, which is desirable from a storage, transportation and display perspective.

In some embodiments, the duct may have a first end, nearest a lower surface of the basin, the potty including a reservoir adjacent the first end, the reservoir configured to have a collecting surface which is lower than the lower surface of the basin so as to collect liquid from it and assist liquid to be directed into the first end of the duct upon tilting of the potty. By providing a reservoir at the base of the duct, liquid will collect there ready to be presented to the duct upon tipping the potty. This may make emptying the potty easier than if the lower surface of the basin is of uniform depth or if a remote area, relative to the base of the duct, is the lowest part.

In some embodiments at least some of the duct is provided along or across at least some of the basin sidewall.

In some embodiments, at least a part of the duct is an open top channel. This makes cleaning the open top part of the channel relatively simple, as it is easily accessible.

In some embodiments, the similar potty is a substantially identical potty.

BRIEF DESCRIPTION OF THE DRAWINGS

Embodiments of the present invention will now be described, by way of example only, with reference to the accompanying drawings, in which.

DETAILED DESCRIPTION

Figure 1:
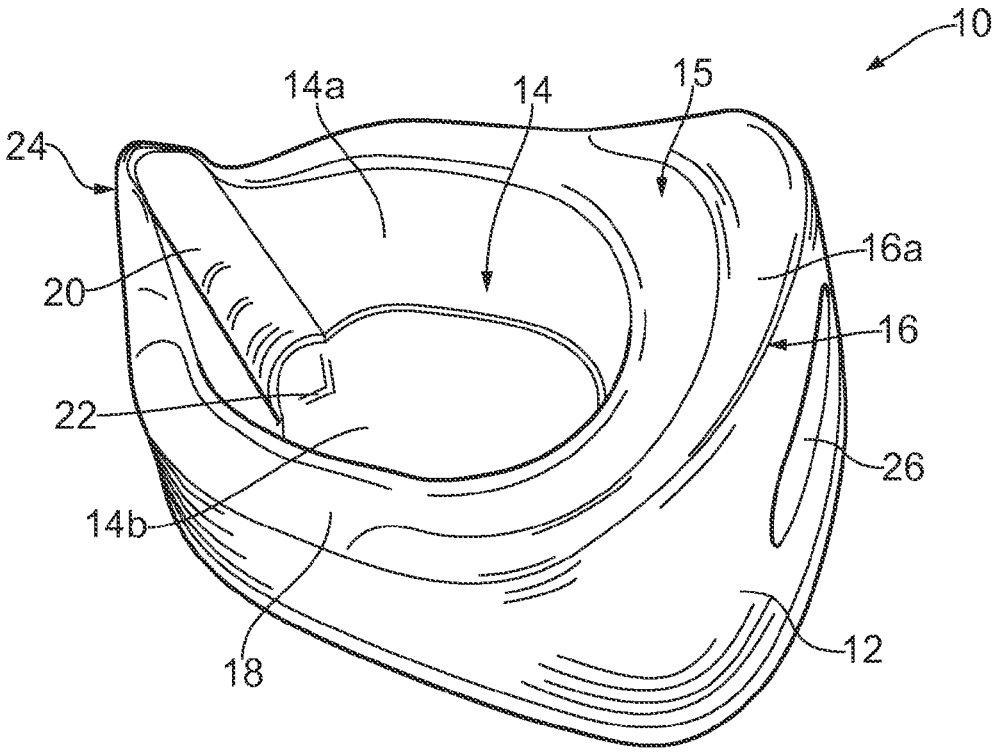
FIG. 1 is a schematic perspective view of a potty according to a first embodiment of the present invention.
Figure 2:
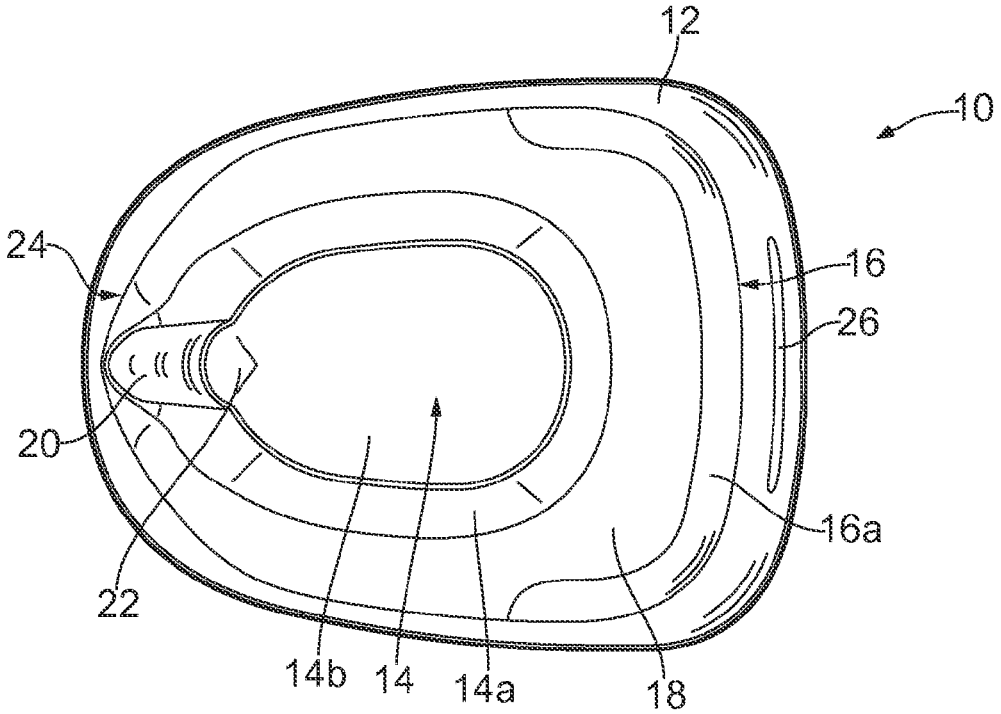
FIG. 2 is a plan view of the potty of FIG. 1.
Figure 3:
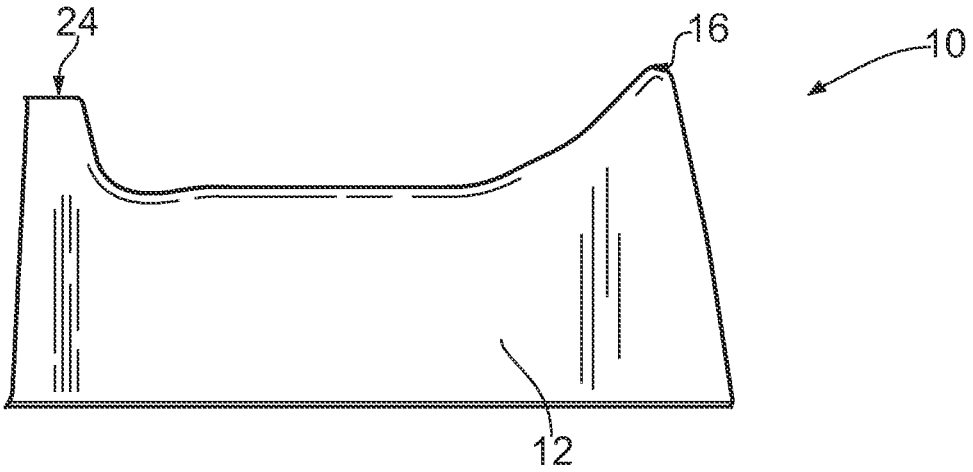
FIG. 3 is a side elevation of the potty of FIG. 1.

Referring to FIGS. 1 to 3, a potty 10 according to an embodiment of the present invention comprises a primary sidewall 12 configured in a closed loop to form a generally rectangular, rounded cornered, shape when viewed from the plan. The primary sidewall 12 is higher at the front and back of the potty 10 than it is at either side. The primary sidewall 12 is sloped inwardly from its bottom to its top, such that the length of its perimeter at the bottom is greater than at its top. A hole 26 is formed through the back face of the primary sidewall 12 to provide a handle.

A basin 14 is located within the closed loop defined by the primary sidewall 12. The basin 14 has a basin sidewall **14*a* configured in a closed loop to form a generally oval shape when viewed from the plan view. The basin sidewall 14*a* is sloped outwardly from its bottom to its top, such that the length of its perimeter at the bottom is less than at its top. The bottom of the basin 14 is closed by a lower surface 14*b* and the top is open. The basin 14 is thus a liquid-tight container which is open at its top. The front part of the basin sidewall 14*a* is higher than the back and the sides, to contribute to a splash guard projection 24**. It should be noted that the basin can be any shape that is suitable to retain liquid whilst also being configured to permit the potty to be stacked with a substantially identical potty such that the combined height of the two potties is less than twice the height of the single potty.

The top of the primary sidewall 12 is connected to the top of the basin sidewall **14*a* by a top surface 15. The sidewalls 12, 14*a* and top surface 15 together form a shell structure that provides rigidity to the potty 10. The top surface 15 includes surfaces arranged to be sat on and surfaces that are not arranged to be sat on. The surfaces arranged to be sat on include the seating surface 18 and a front face 16*a* of a backrest 16**. It will thus be appreciated that in some embodiments a surface arranged to be "sat on" includes any surface that in normal use is likely to come into contact with the skin of an average user.

The seating surface 18 is ergonomically contoured for a child to sit comfortably thereon and generally defines a horizontal plane. It is desirable that water emptied from the basin 14 does not contact the seating surface 18, or the front face **16*a* of the backrest 16**, as each of these surfaces are likely to come into contact with a users skin.

The front face 16*a* of the backrest 16 is connected to the seating surface 18. However, the front face 16*a* has a steeper gradient than the seating surface 18 to provide a degree of horizontal support to a user sat on the potty 10. The top part of the front face 16*a* of the backrest 16 is connected to the top rim of the back part of primary sidewall 12. It will be appreciated that in practice the potty may be formed by injection moulding, from a plastics material, and thus reference to "connected to" and the like also covers the parts in question being integrally formed with one another.

The splash guard 24 is composed of the front part of the primary sidewall 12, the front part of the basin sidewall 14*a* and the upper face between them. An open channel 20 extends from a location adjacent the lower surface 14*b* of the basin 14 to a location adjacent to the top of the splash guard projection 24. The channel 20 has a cross section, through a plane perpendicular to the longitudinal axis of the channel 20 that generally resembles a segment of a circle. In any embodiment of the invention, the channel could be a closed conduit or any other suitable duct. An open topped channel has the advantage that it is easier to clean than a closed conduit, for example should any solid waste matter become attached to the duct. In some embodiments a suitable duct is one that enables liquid to be poured out of the basin substantially without the liquid contacting the seating surface. The channel can be flat sided with a liquid transfer surface between the sides, or any other shape that enables a reasonable amount of liquid to flow along it whilst retaining the liquid in the channel. The channel is shown to be straight, as this provides the most direct route for liquid from one end of the channel to the other. However, the channel need not be straight. It is advantageous that the channel 20 is wide enough to permit easy access for cleaning, for example the channel 20 in this embodiment is at least 20 mm wide. In other embodiments the channel 20 may be any width in the range of 10 mm to 100 mm and in some embodiments up to 150 mm wide. The channel 20 may be of uniform width, or the width may vary, for example the channel 20 may be wider towards its base and narrower towards its top. Providing a duct to provide a passageway for liquid out of the potty is advantageous in comparison with, for example, providing a valve through the basin as a valve requires opening and closing which adds complexity to the potty and furthermore the valve can be contaminated with waste products, meaning that touching a valve may not be desirable from a hygiene perspective. The duct according to embodiments of the invention is valveless. Instead, the orientation of the potty regulates whether liquid can flow along the duct and out of the potty. It will be appreciated that this means the potty can be emptied without having to touch a surface with which waste has come into contact.

The lower surface 14*b* of the basin 14 has a shallow recess 22 located adjacent to or at the base of the channel 20. The shallow recess 22 and lower surface 14*b* of the basin 14 are arranged such that liquid entering the basin moves towards the shallow recess 22. This locates liquid at a convenient place to be subsequently poured from the potty 10. The shallow recess, or collecting pool, may be included in any of the described embodiments. However, it will be appreciated that the shallow recess is a preferred feature and may not be included in all embodiments of the present invention.

When viewed from above, as shown in FIG. 2, the primary sidewall 12, basin sidewall 14*a*, channel 20 and top surface 15 are configured so as to define release angles with respect to a vertical axis. Generally, this is as a result of the primary sidewall 12 sloping inwardly from bottom to top and the basin sidewall 14*a* and channel 20 sloping outwardly from bottom to top. The potty 10 has a hollow base and thus a cavity exists between the primary sidewall 12, basin sidewall 14*a*, and top surface 15. It will be appreciated that because the potty is formed of a generally uniform thickness material, for example, 3 mm thick plastics material, the surface profile of the underside will correspond to the outside. Accordingly, the surface profile of the underside defines release angles corresponding to those of the outside of the potty. The configuration of the potty 10 permits the potty to be stackable with another similar potty. The outside of the potty 10 is arranged to permit mating engagement with the underside of a substantially identical potty i.e. the potty 10 is arranged such that at least a part of it can be received by another, similar or substantially identical, potty. In the illustrated embodiment, the potty 10 includes the cavity between the primary sidewall 12, basin sidewall 14*a* and top surface 15 which defines a space within which the upper surface, the backrest, a part of main sidewall and cavity sidewall and a part of the duct a similar potty can be received. When two potties are stacked together in this way, the combined height of the stacked potties i.e. the distance from the highest part of the backrest 16 of the top potty to the underlying base of the bottom potty will be less than twice the height of a single potty 10. In some embodiments, the combined height of the two potties may be less than one and a half times the height of a single potty and in some cases substantially 1.2 or 1.1 times the height of a single potty.

The potty 10 is made, in this embodiment, from polyethylene. However, the potty may be made from any suitable material, such as a plastics material, having the necessary strength characteristics to support a user whilst also being resistant to the liquids and other waste products the potty will encounter in use.

In use, a child sits on the potty and in doing so it is likely that the child's skin will come into contact with the seating surface 18 and the front face 16*a* of the back rest 16. Once the child has passed bodily waste, for example urine, into the basin 14 of the potty 10, the urine collects near the base of the channel 20 in the shallow recess 22 and, depending on the quantity of urine provided, possibly other parts of the lower surface 14*b*. The urine may be poured out of the basin 14 by pitching the potty 10 downwardly, thereby presenting the urine to the channel 20 such that it may flow from the base of the channel 20 to the distal end and from the channel 20 into some disposal area, such as a toilet. The urine substantially will not come into contact with a skin-contacting surface due to the fact that the channel 20 is formed in a surface of the potty 20 that is not arranged to be sat on. The term "pouring" is used to denote tilting the potty by a degree of rotation less than 180 degrees, such that liquid therein will, due to gravity, be forced against the basin sidewall 14*a*. It will be appreciated that tilting the potty by 180 degrees or more is undesirable, as pouring may become less controllable than when tilting the potty by an amount less than 180 degrees.

Figure 4:
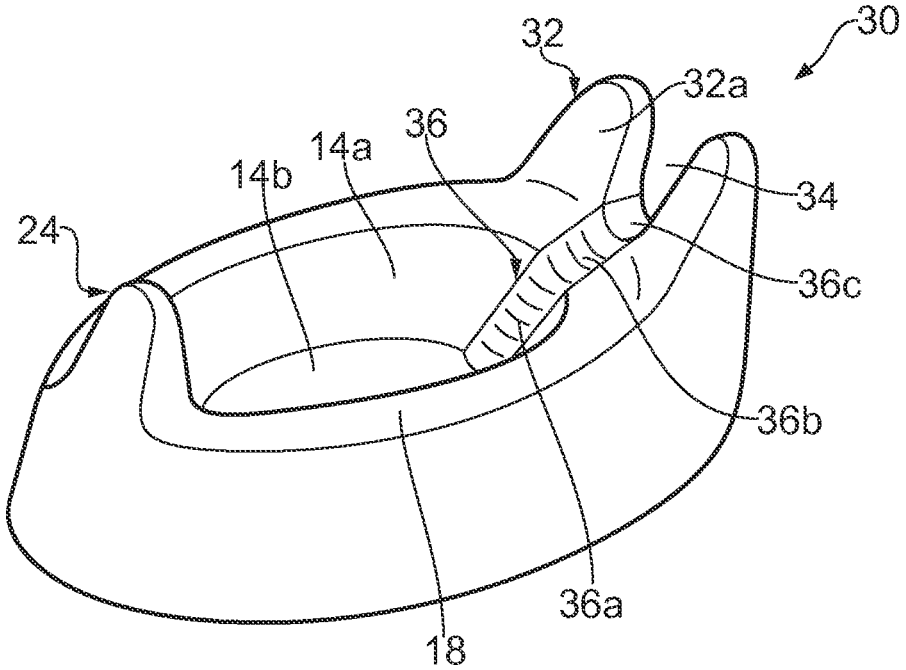
FIG. 4 is a schematic perspective view of a potty according to a second embodiment of the present invention.

Referring to FIG. 4, a potty 30 is shown according to a second embodiment of the present invention. The potty 30 is similar to the potty 30 according to the first embodiment except that, instead of the channel 36 extending along the splash guard 24, the channel 36 extends from the lower surface 14*b* of the basin 14 to the back of the potty 30. As can be seen, the channel 36 includes a first portion 36*a* formed in the basin side wall 14*a*, a second portion 36*b* formed in the seating surface 18 and a third portion 36*c* providing an outlet at the back of the potty. In this embodiment, the backrest 32 has a slot 34 formed through it. The slot 34 has a base along which the third portion 36*c* of the channel 36 extends. The base of the slot 34 and the channel 20 may be one and the same. The slot 34 is narrower at its bottom than at its top. The two halves 32*a* of the back rest 32 taper inwardly from bottom to top and are hollow, thereby providing a release angled profile that enables the potty 30 to be stackable as in the first embodiment. However, it will be appreciated that the two halves of the back rest could be any suitable shape.

The second portion 36*b* of the channel 36 crosses the seating surface 18. By way of clarification, the term "crosses" is intended to mean that in a plan view at least some of the duct is directly above, below or intersects at least some of the seating surface. In this embodiment the second portion 36*b* of the channel 36 intersects the seating surface 18. Consequently the distance between the liquid transfer surface of the second portion 36*b* of the channel 36 and the seating surface 18 is sufficient to prevent the skin of a person sitting on the potty in normal use from coming into contact with the liquid transfer surface of the second portion 36*b* of the channel 36. This distance can be provided by the depth of the second portion 36*b* of the channel 36. For example, in this embodiment the liquid transfer surface of the second portion 36*b* of the channel is at least 10 mm below the general plane of the seating surface 18 adjacent the channel. In other embodiments the distance may be in the range of 5 mm to 65 mm and preferably in the range of 10 mm to 40 mm and more preferably in the range of 10 mm to 20 mm.

In use, pitching the potty 30 backwards will cause liquid in the basin 14 to run along the channel 36 and exit the channel at the outlet of the third portion 36*c*.

Figure 5:
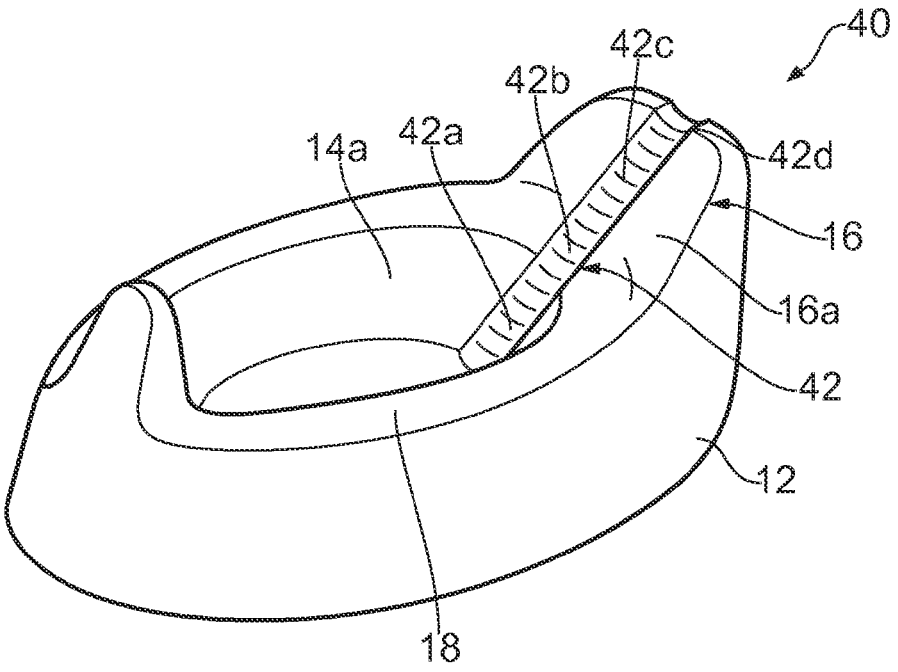
FIG. 5 is a schematic perspective view of a potty according to a third embodiment of the present invention.

Referring to FIG. 5, a potty 40 is shown according to a third embodiment of the present invention. The potty 40 in this embodiment is similar to the potty 30 of the second embodiment. However, the backrest 16 is substantially the same as in the first embodiment. In this embodiment the channel 42 includes a first portion 42*a* formed in the basin side wall 14*a*, a second portion 42*b* formed in the seating surface 18, a third portion 42*c* formed through the front face 16*a* of the backrest 16 and a fourth portion 42*d* formed in the top of the backrest, to define an channel outlet opening onto the back of the primary sidewall 12. The same considerations apply to the second portion 42*b* in this embodiment as to the second portion 36*b* in the second embodiment. In this embodiment the third portion 42*c* of the channel 42 is also sufficiently recessed to prevent the skin of a person sitting on the potty, in normal use, from coming into contact with the liquid transfer surface, due to the third portion 42*c* of the channel 42 extending across the front face 16*a* of the backrest 16.

In use, pitching the potty 40 backwards will cause liquid in the basin 14 to run along the channel 42 and exit the channel at the outlet of the fourth portion 42*d*.

Figure 6:
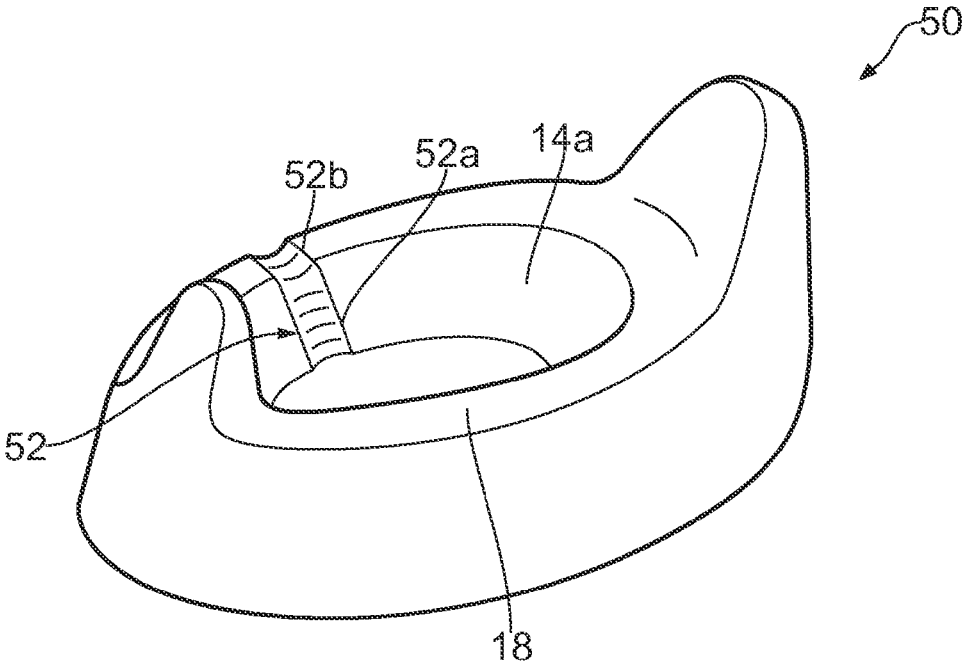
FIG. 6 is a schematic perspective view of a potty according to a fourth embodiment of the present invention.

Referring to FIG. 6, a potty 50 is shown according to a fourth embodiment of the present invention. In this embodiment the channel 52 has a first portion 52*a* extending up the basin sidewall 14*a* and a second portion 52*b* extending across the seating surface 18 at the side of the potty 50. As with the second and third embodiments, the channel 52 is sufficiently recessed to prevent the skin of a person sitting on the potty, in normal use, from coming into contact with the liquid transfer surface of the channel 52.

Figure 7:
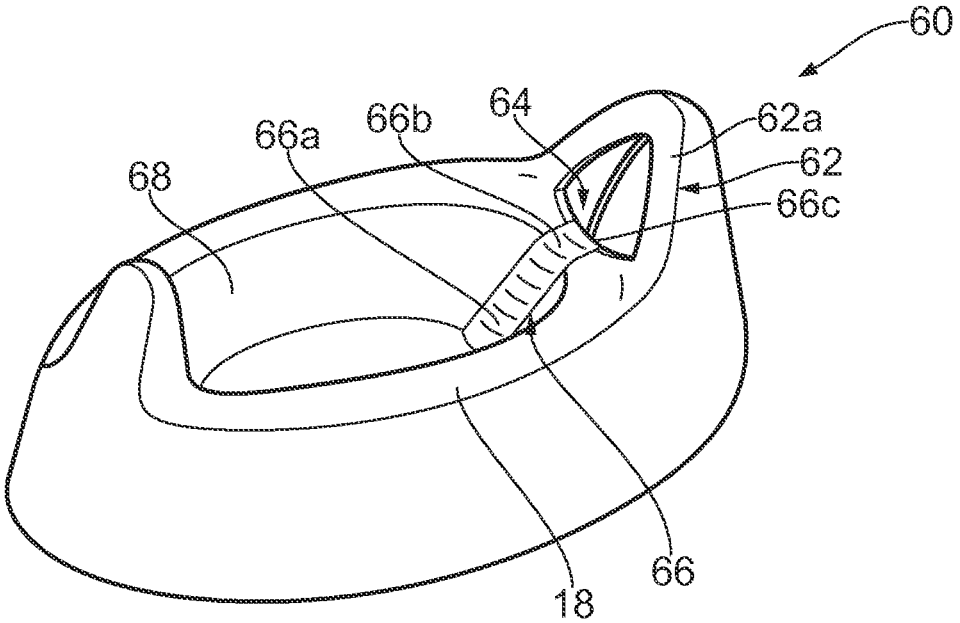
FIG. 7 is a schematic perspective view of a potty according to a fifth embodiment of the present invention.
Figure 8:
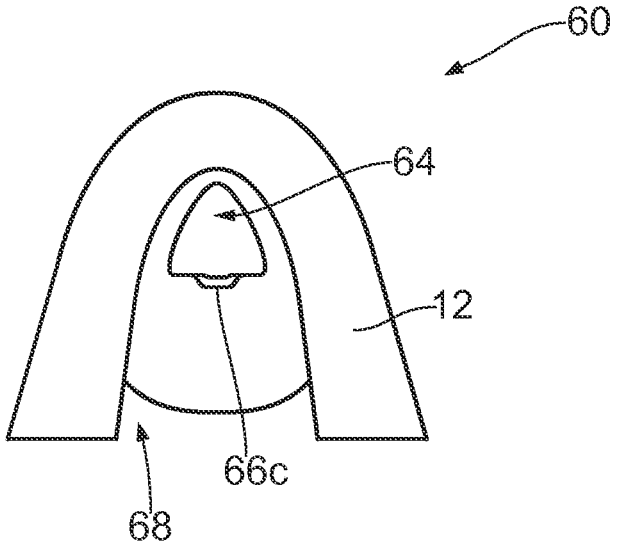
FIG. 8 is a back elevation of the potty of FIG. 7.

Referring to FIGS. 7 and 8, a potty 60 is shown according to a fifth embodiment of the present invention. This embodiment is similar to the second embodiment. However in this embodiment the front face 62*a* of the backrest 62 has a first opening 64 formed through it, at a location adjacent the seating surface 18. A channel 66 extends from the basin 68, which in this embodiment is a recess having a curved cross-section, rather than having walls and a lower surface. The channel 66 includes a first portion 66*a* that extends up the wall of the basin 68, a second portion 66*b* that extends across the seating surface 18 up to the first opening 64 and a third portion 64 that projects through the opening 64 to form a lip or spout. As can be seen from FIG. 7, a second opening 68 is formed through the primary sidewall 12 at the back of the potty, through which opening 68 the first opening 64 and lip 66*c* can be seen. The purpose of the second opening is to provide a space through which liquid poured along the channel 66 and leaving the lip 66*c* can pass without impacting on the inside face of the primary sidewall 12 which would otherwise need to be cleaned. The first opening 64 also provides a space in which the lip 66*c* of a second potty 60 to be stacked on top of the potty 60 may be located when stacked.

Figure 9:
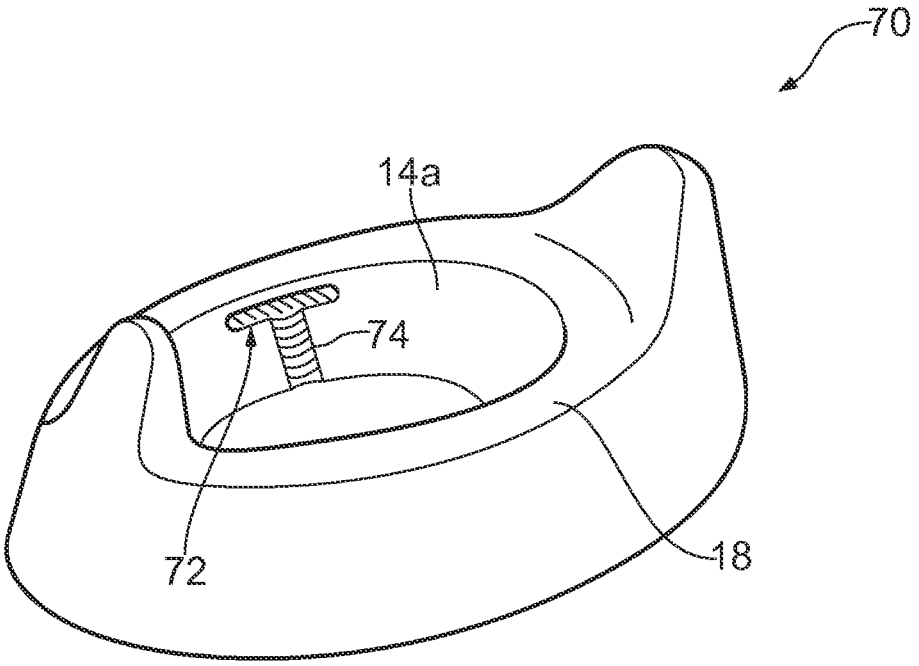
FIG. 9 is a schematic perspective view of a potty according to a sixth embodiment of the present invention.
Figure 10:
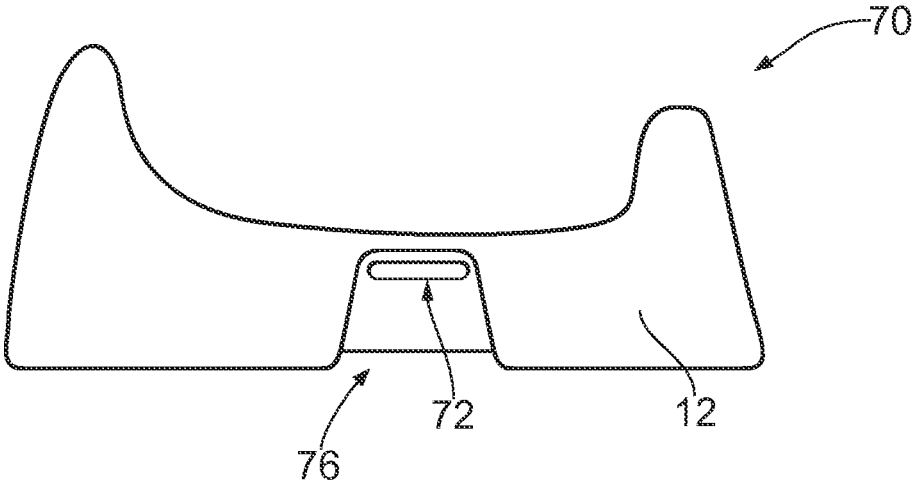
FIG. 10 is a side elevation of the potty of FIG. 9.
Figure 11:
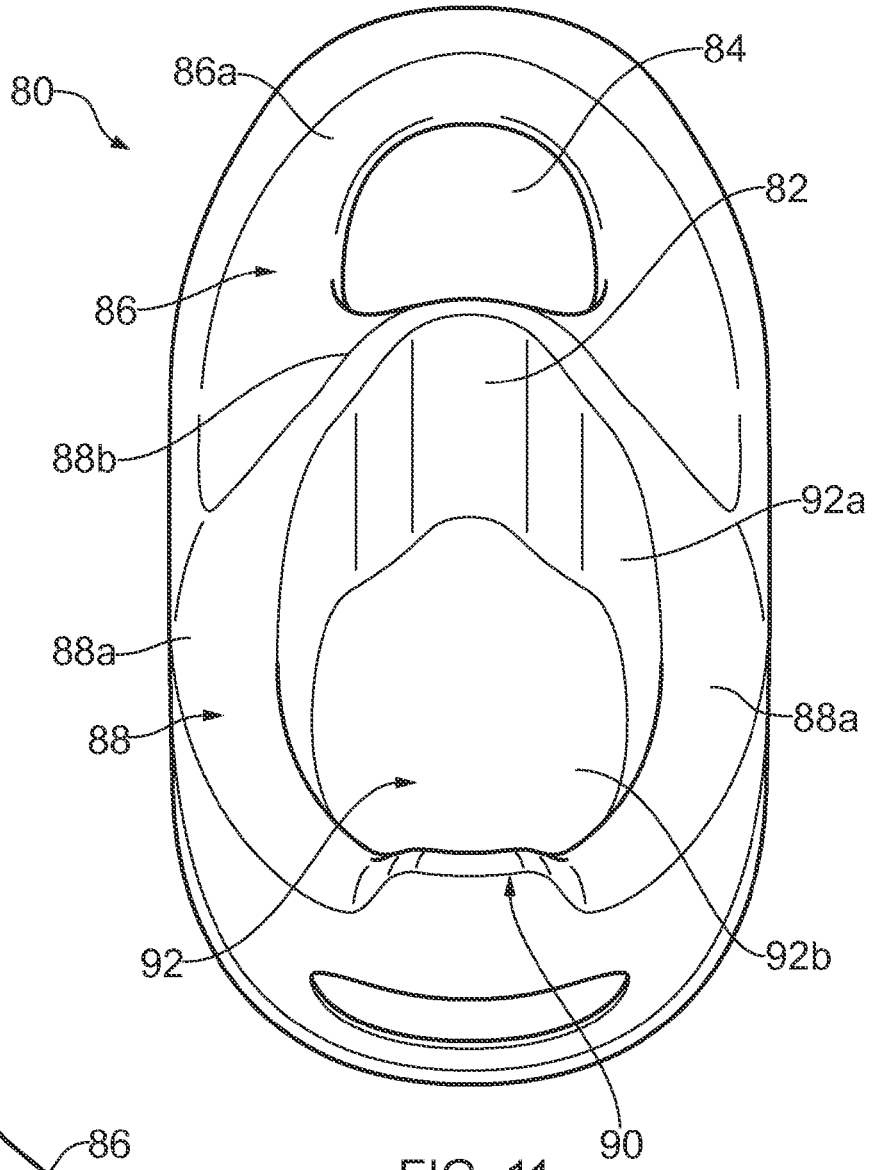
FIG. 11 is an off-centre top view of a potty according to a seventh embodiment of the present invention.
Figure 12:
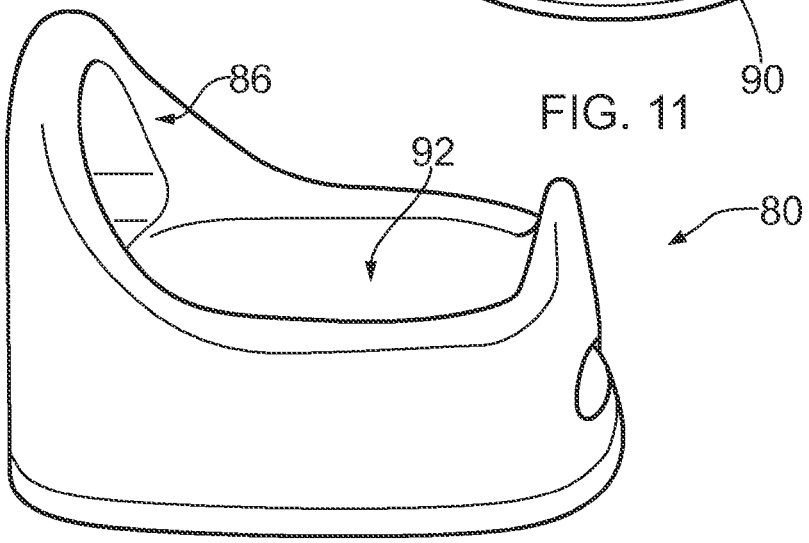
FIG. 12 is a perspective view from the side of the potty of FIG. 11.
Figure 13:
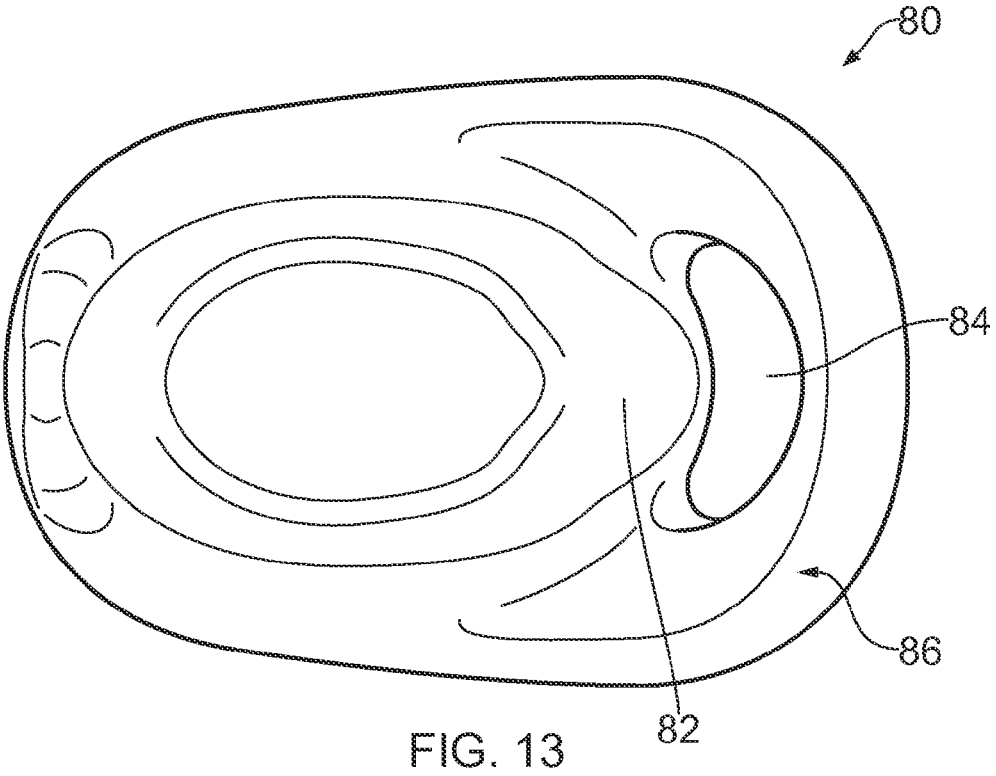
FIG. 13 is a perspective view from above of the potty of FIG. 11.
Figure 14:
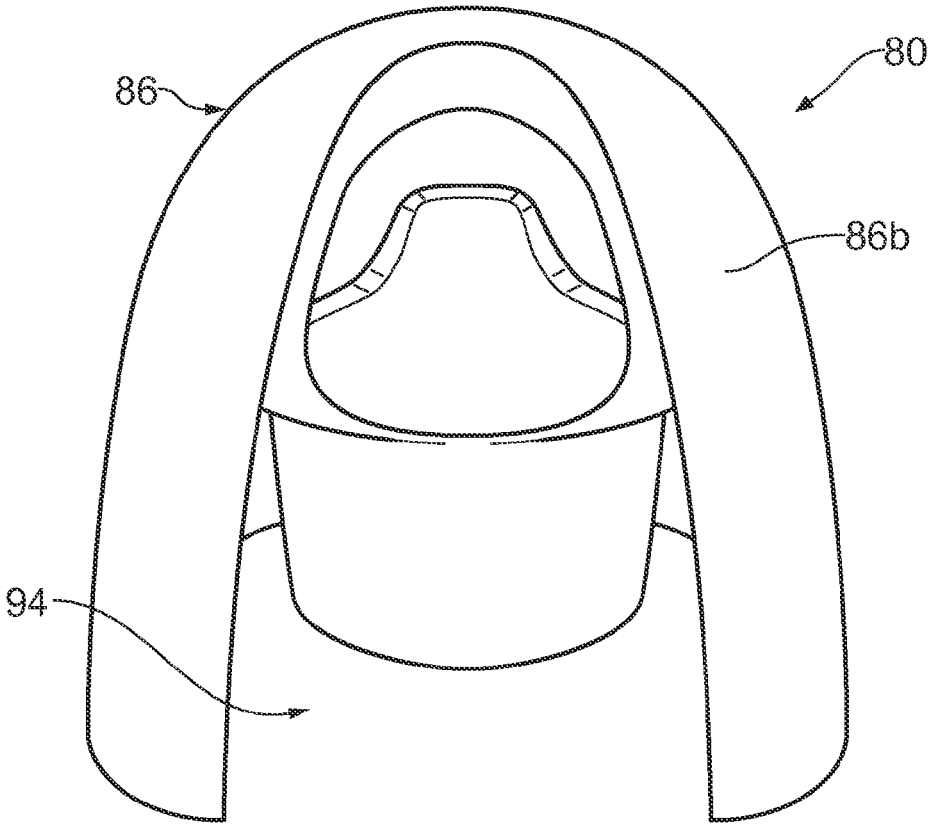
FIG. 14 is a perspective view from the back of the potty of FIG. 11.

FIGS. 9 and 10 show a potty 70, according to a sixth embodiment of the present invention. The potty 70 according to this embodiment is similar to the potty 50 of the fourth embodiment. However, the channel 74 leads to a first opening 72 formed through the basin sidewall 14*a* at a location below the seating surface 18. A second opening 76 is formed through the primary sidewall 12 at the side of the potty 70, the second opening 76 corresponding to the location of the first opening 72 and providing a similar function to that of the second opening 68 in the fifth embodiment. In another embodiment a tube may be provided on the opposite side of the first opening 72 relative to the basin. The tube is in fluid communication with the inside of the basin and opens onto the outside face of the primary sidewall 12. Thus, the tube crosses the seating surface 18 but does not intersect it. This may in some embodiments restrict how much of one potty may be received by the other, as the underside of the tube will come into contact with the seating surface of another potty when the two potties are stacked.

In use, the potty 70 may be rolled towards the channel 74, wherein liquid will travel along the channel 74 and exit the basin via the first opening 72. This embodiment, like the first embodiment, has the advantage that the channel does not intersect the seating surface 18 which may cause discomfort to a user.

Referring to FIGS. 11 to 14, a potty 80 is shown according to a seventh embodiment of the present invention. The potty 80 is similar to the potty 30 of the second embodiment and the potty 60 of the fifth embodiment. One similarity is that the potty 80 includes a channel 82 that leads to an opening 84 through which liquid and solids may be poured. The opening 84 shown is a generally egg-shaped aperture formed through the front surface 86*a* of the backrest 86. However it is to be understood that the opening 84 can be any shape or configuration that enables liquid and solid waste to be poured from the potty, using the channel 82, without liquid or solid waste contacting the seating surface, For example, the opening 84 could be an open-top passageway, such as the slot 34 shown in FIG. 4. In some cases the opening 84 may be formed through a surface of the potty other than the backrest 86, such as through the basin sidewall.

At last some of the backrest 86 is arranged to provide support for the lower back of a user, when sat on the potty 80 and this shall be referred to as the supporting face 86*a* of the backrest. It will be appreciated that the backrest 16 limits how far back a user can sit on the potty 80. The potty 80 has a top surface 88 having areas arranged to be sat on and areas that are not arranged to be sat on. In the example shown, the side areas 88*a* are areas arranged to be sat on and thus form part of the seating surface. The rear area 88*b* of the top surface 88 is not arranged to be sat on because the supporting face 86*b* of the backrest limits how far backwards an average user can sit. Generally speaking, the backrest 86 is configured to prevent a user's skin coming into contact with the rear area 88*b* of the top surface 88 due to the configuration of the supporting face 86*a* of the backrest 86. The potty is arranged to prevent a user's skin, during normal use, from entering into close proximity, and in some embodiments from entering into contact with the channel 84. Generally, this means preventing a user's skin from contacting areas of the potty adjacent the channel 82. The potty 80 also includes a splash-guard projection 90 which is not a surface arranged to be sat on. It will be appreciated that potty 80 need not include a splash-guard projection 90.

The channel 82 in this example is provided along the basin sidewall 92*a*, at a generally rear portion thereof and is in the range of 100 mm to 200 mm wide. This general range assists solids to be poured or transferred along the channel 82 and out of the opening 84. Furthermore, the channel 84 is easy to clean. In some embodiments the channel may be wider at some locations than at others. The channel 82 extends up the basin sidewall 92*a* and has a first end adjacent the base 92*b* of the basin 92 and a second end adjacent the opening 84, such that liquid and solids can be poured along the channel 82 and out of the opening 84. The second end of the channel 84 defines a lip. It should be noted that the lip in some embodiments is no further back than a vertical plane intersecting the top of the opening 84 as this assists in providing a stackable potty.

The seating surface, which includes the supporting face 86*a* of the backrest, is configured to maintain a user in a seating position such that the user's skin is spaced from the channel. The part of the potty forming the upper region of the channel 82 is sufficiently set back from the seating surface such that an average user will not, in use, contact the channel 84 itself or, in some embodiments, parts of the potty in the space adjacent to the upper region of the channel 84. In this example the channel 82 is set back from and below the general surface profile of the seating surface and thus the does not cross the seating surface. In other embodiments the channel may be set further back from the supporting face 86*a* of the backrest 86. The seating surface therefore, in plan view, forms a generally "C" shaped surface, with the broken part of the "C" facing the front of the potty 80. The basin 92, channel 82 and the opening 84 are each contained within the "C" shaped seating surface such that the seating surface partially envelops the basin 92, channel 82 and the opening 84. However, in other embodiments the channel 82 may cross and in some cases intersect the seating surface, which may be the case if the location of the channel is further forwards as shown in FIG. 7, such that a part of the potty adjacent the channel forms part of the seating surface.

The potty 80 includes a second opening 94 formed through the back of the primary sidewall at a location corresponding to the opening 84. The second opening 94 is generally arch-shaped and is larger than the opening. The second opening 94 is arranged to permit liquid and solid waste to be poured out of the opening 84 substantially without the waste contacting the inside of the primary sidewall, which would involve cleaning.

An advantage with the embodiments shown in FIGS. 4 to 11 is that their respective channels are located at positions where it is unlikely that a child sitting on the potty in normal use will touch the channels, which is advantageous from a hygiene perspective.

Whilst a channel is shown in the various embodiments as a discontinuity in the surface profile of the potty, in some embodiments the basin sidewall or sidewalls may be arranged and configured to define a duct arranged to enable liquid to be poured out of the basin substantially without the liquid contacting the seating surface. An example would be an oval or egg shaped basin with an opening provided through the potty at an area adjacent part of the basin with the smallest radius of curvature i.e. the top of the egg.

The invention claimed is:

1. A potty comprising a basin, a seating surface and a duct arranged to enable liquid to be poured out of the basin without the liquid contacting the seating surface, wherein:

the potty includes a primary sidewall, the basin includes a basin sidewall and the seating surface is provided between the sidewalls, one end of the duct is provided at or adjacent to a first opening formed through a surface of the potty, such that liquid can be poured along the duct to the first opening, at least some of the duct is provided along or across at least some of the basin sidewall, the duct is arranged such that it crosses the seating surface, the potty includes a drain aperture formed through a surface thereof, the duct extending to the drain aperture such that liquid may flow from an area of the basin to the drain aperture via the duct, the potty includes a backrest having a support surface and the drain aperture is formed through the support surface of the backrest, and the potty is configured to be stackable with a similar potty such that at least a part of the potty may be received by the similar potty.

2. A potty according to claim 1, wherein the first opening is formed through a part of the backrest.

3. A potty according to claim 1, wherein a second opening is formed through the primary sidewall at a location corresponding to the first opening, the second opening being larger than the first opening.

4. A potty according to claim 1, wherein the seating surface includes a groove extending across it, the groove having a base along which the duct extends.

5. A potty according to claim 1, wherein the potty includes a backrest and the duct extends across the backrest.

6. A potty according to claim 1, wherein at least some of the basin is arranged to be received, when stacked, within the basin of the similar potty.

7. A potty according to claim 1, wherein the duct has a first end, nearest a lower surface of the basin, the potty including a reservoir adjacent the first end, the reservoir configured to have a collecting surface which is lower than the lower surface of the basin so as to collect liquid from it and enable collected water to be directed into the first end of the duct upon tilting of the potty.

8. A potty according to claim 1, wherein the similar potty is an identical potty.

9. A potty comprising a basin, a seating surface and a duct arranged to enable liquid to be poured out of the basin without the liquid contacting the seating surface, wherein one end of the duct is provided at or adjacent to a first opening formed through a surface of the potty, such that liquid can be poured along the duct to the first opening, wherein the potty is configured to be stackable with a similar potty such that at least a part of the potty may be received by the similar potty; and wherein the potty further comprises a backrest and the first opening is formed through a part of the backrest, and wherein the backrest defines a support surface arranged to support the lower back of a user and the duct is spaced from the support surface, such that the support surface prevents a user's skin, in normal use of the potty, from coming into contact with the duct.

10. A potty comprising a basin, a seating surface and a duct arranged to enable liquid to be poured out of the basin without the liquid contacting the seating surface, wherein the duct is arranged such that it crosses the seating surface, and the potty further includes a backrest and the duct extends across the backrest, and wherein the potty is configured to be stackable with a similar potty such that at least a part of the potty may be received by the similar potty.

* * * * *